US009613585B2

(12) United States Patent
Tanaka et al.

(10) Patent No.: US 9,613,585 B2
(45) Date of Patent: Apr. 4, 2017

(54) DISPLAY DEVICE AND METHOD FOR DRIVING THE SAME

(71) Applicant: Sharp Kabushiki Kaisha, Osaka-shi, Osaka (JP)

(72) Inventors: Noriyuki Tanaka, Osaka (JP); Kouji Kumada, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 62 days.

(21) Appl. No.: 14/373,986

(22) PCT Filed: Jan. 25, 2013

(86) PCT No.: PCT/JP2013/051557
§ 371 (c)(1),
(2) Date: Jul. 23, 2014

(87) PCT Pub. No.: WO2013/115088
PCT Pub. Date: Aug. 8, 2013

(65) Prior Publication Data

US 2014/0368484 A1 Dec. 18, 2014

(30) Foreign Application Priority Data

Feb. 2, 2012 (JP) ..... 2012-020591

(51) Int. Cl.
*G06F 3/038* (2013.01)
*G09G 3/36* (2006.01)

(52) U.S. Cl.
CPC ..... *G09G 3/3696* (2013.01); *G09G 3/3648* (2013.01); *G09G 3/3614* (2013.01);
(Continued)

(58) Field of Classification Search
CPC ... G09G 3/3696; G09G 3/3648; G09G 3/3614
(Continued)

(56) References Cited

U.S. PATENT DOCUMENTS

2002/0041281 A1 4/2002 Yanagi et al.
2002/0093473 A1 7/2002 Tanaka et al.
(Continued)

FOREIGN PATENT DOCUMENTS

CN 1440514 A 9/2003
JP 05-188869 A 7/1993
(Continued)

OTHER PUBLICATIONS

Official Communication issued in International Patent Application No. PCT/JP2013/051557, mailed on Feb. 26, 2013.

*Primary Examiner* — Andrew Sasinowski
*Assistant Examiner* — Kuo Woo
(74) *Attorney, Agent, or Firm* — Keating & Bennett, LLP

(57) ABSTRACT

Provided is a display device capable of switching a refresh rate while suppressing deterioration in display quality and degradation in liquid crystal. In the case of switching the refresh rate from 60 Hz to 7.5 Hz, a transition period for gradually changing the refresh rate from 60 Hz to 7.5 Hz is provided between a 60-Hz period and a 7.5-Hz period. This transition period is configured by sequentially arraying a 30-Hz period, a 20-Hz period, a 15-Hz period, a 12-Hz period and a 10-Hz period from a start point of the transition period. Hence the refresh rate gradually changes from 60 Hz to 7.5 Hz sequentially through 30 Hz, 20 Hz, 15 Hz, 12 Hz and 10 Hz. The number of positive-polarity frames and the number of negative-polarity frames are respectively 20 in the whole of the transition period, and are equal to each other.

8 Claims, 13 Drawing Sheets

(52) U.S. Cl.
CPC ... *G09G 3/3655* (2013.01); *G09G 2320/0204* (2013.01); *G09G 2320/0613* (2013.01); *G09G 2330/021* (2013.01); *G09G 2340/0435* (2013.01)

(58) Field of Classification Search
USPC ..... 345/690, 213, 204
See application file for complete search history.

(56) References Cited

U.S. PATENT DOCUMENTS

| | | | | |
|---|---|---|---|---|
| 2002/0180673 | A1 | 12/2002 | Tsuda et al. | |
| 2003/0090500 | A1* | 5/2003 | Yamazaki | 345/690 |
| 2004/0036669 | A1 | 2/2004 | Yanagi et al. | |
| 2005/0140632 | A1 | 6/2005 | Tsuda et al. | |
| 2009/0237391 | A1* | 9/2009 | Yanagi et al. | 345/213 |
| 2012/0320009 | A1* | 12/2012 | Liu | G09G 3/3614 345/204 |

FOREIGN PATENT DOCUMENTS

| | | | |
|---|---|---|---|
| JP | 05-196914 | A | 8/1993 |
| JP | 08-234876 | A | 9/1996 |
| JP | 2000-347762 | A | 12/2000 |
| JP | 2001-312253 | A | 11/2001 |
| JP | 2002-116739 | A | 4/2002 |
| JP | 2002-278523 | A | 9/2002 |
| JP | 2004-078124 | A | 3/2004 |
| JP | 2005-037685 | A | 2/2005 |
| WO | 2008/015814 | A1 | 2/2008 |

* cited by examiner

DISPLAY DEVICE AND METHOD FOR DRIVING THE SAME

TECHNICAL FIELD

The present invention relates to a display device, and particularly relates to a display device that performs a pause drive and a method for driving the same.

BACKGROUND ART

There has hitherto been required reduction in power consumption in display devices such as liquid crystal display devices. Accordingly, for example, Patent Document 1 discloses a method for driving a display device where, after a scan period (also referred to as charge period) T1 in which gate lines of a liquid crystal display device are scanned to refresh a screen, a pause period T2 in which all the gate lines are brought into a non-scanned state to pause the refresh is provided. In this pause period T2, it is possible to prevent a controlling signal from being given to a gate driver and/or a source driver, for example. Hence it is possible to pause operations of the gate driver and/or the source driver, so as to lower power consumption. The drive that is performed by providing the pause period after the charge period as in the drive method described in this Patent Document 1 is called a "pause drive", for example. In addition, this pause drive is also called a "low-frequency drive" or an "intermittent drive". Such a pause drive is preferable for a still image display. Inventions related to the pause drive are also disclosed in Patent Documents 2 to 5 besides Patent Document 1.

In a display device that performs the pause drive, it is generally possible to switch between a normal drive with a refresh rate of 60 Hz or higher, for example, and a pause drive with a refresh rate of lower than 60 Hz, for example. This allows lowering of power consumption in a manner suitable for an image to be displayed.

PRIOR ART DOCUMENTS

Patent Documents

[Patent Document 1] Japanese Patent Application Laid-Open No. 2001-312253

[Patent Document 2] Japanese Patent Application Laid-Open No. 2000-347762

[Patent Document 3] Japanese Patent Application Laid-Open No. 2002-278523

[Patent Document 4] Japanese Patent Application Laid-Open No. 2004-78124

[Patent Document 5] Japanese Patent Application Laid-Open No. 2005-37685

SUMMARY OF THE INVENTION

Problems to be Solved by the Invention

Incidentally, a potential (hereinafter referred to as "pixel potential", denoted by symbol Vp") written in a pixel electrode via a TFT (Thin Film Transistor) in a display panel changes with passage of time. This is because an electric charge held in a pixel capacitance made up of a liquid crystal capacitance or the like leaks as a leakage current via the TFT with passage of time. FIGS. 13(A) and 13(B) are signal waveform diagrams showing a situation in which a pixel potential Vp varies depending on the refresh rate. More specifically, FIG. 13(A) is a signal waveform diagram showing the pixel potential Vp in the case of the refresh rate being 60 Hz, and FIG. 13(B) is a signal waveform diagram showing the pixel potential Vp in the case of the refresh rate being 1 Hz. It is to be noted that a liquid crystal voltage Vlc that is held in a pixel capacitance Cp corresponds to a potential difference between the pixel potential Vp and a common potential Vcom. As shown in FIG. 13(A), when the refresh rate is 60 Hz, a period in which the liquid crystal voltage Vlc is to be held is relatively short, and the change in pixel potential Vp is thus small. On the other hand, as shown in FIG. 13(B), when the refresh rate is 1 Hz, a period in which the pixel potential Vp is to be held is relatively long, and the change in pixel potential Vp is thus large. For this reason, the effective liquid crystal voltage Vlc (hereinafter referred to as "effective liquid crystal voltage") varies between the case of the refresh rate being 60 Hz and the case of that being 1 Hz. In such a case as above where the refresh rate abruptly changes (not restricted to the case of changing from 60 Hz to 1 Hz, but similarly in the case of changing from 60 Hz to 15 Hz, 12 Hz, 10 Hz, 7.5 Hz, 6 Hz, 5 Hz or the like, for example, or in the case of changing from 1 Hz to 60 Hz, or the like), the effective liquid crystal voltage abruptly changes. For this reason, a display luminance changes before and after switching of the refresh rate even when the same screen is displayed, which can thus bring about deterioration in display quality.

Further, at the time of switching the refresh rate as thus described, the polarity balance (referred to as "DC balance" in the present specification) of the liquid crystal voltage Vlc is required to be considered so as to suppress degradation in liquid crystal.

Accordingly, an object of the present invention is to provide a display device capable of switching a refresh rate while suppressing deterioration in display quality and degradation in liquid crystal.

Means for Solving the Problems

According to a first aspect of the present invention, there is provided a display device, including: a display portion which includes a plurality of pixel formation portions; a drive portion which drives the display portion; and a display control portion which controls the drive portion based on data received from the outside, wherein the display control portion performs control for an alternating current drive, and provides a transition period including a period, in which the display portion is to be driven based on at least one refresh rate taking a value between a first value and a second value, between a first drive period in which the display portion is to be driven based on the first value and a second drive period in which the display portion is to be driven based on the second value in the case of switching a refresh rate, which is decided in accordance with a proportion of a refresh period for refreshing a screen of the display portion and a non-refresh period for pausing the refresh of the screen, from the first value to the second value, and provides a positive polarity period made up of a refresh period in which a refresh is performed in a positive polarity and a non-refresh period immediately after the refresh period, and a negative polarity period made up of a refresh period in which a refresh is performed in a negative polarity and a non-refresh period immediately after the refresh period, in substantially the same proportion as each other in a whole of the transition period.

According to a second aspect of the present invention, in the first aspect of the present invention, the display control portion provides the positive polarity period and the negative polarity period in substantially the same proportion as each other with respect to each refresh rate in the transition period.

According to a third aspect of the present invention, in the first or second aspect of the present invention, the display control portion switches a potential to be commonly given to the plurality of pixel formation portions in accordance with the refresh rate.

According to a fourth aspect of the present invention, in the first or second aspect of the present invention, the display control portion switches the second drive period to the first drive period when receiving, from the outside, image data corresponding to the screen of the display portion during the non-refresh period of the second drive period, and then switches the first drive period to the second drive period after the transition period.

According to a fifth aspect of the present invention, in the first or second aspect of the present invention, pixel formation portion includes a thin-film transistor in which a control terminal is connected to a scan line in the display portion, a first conduction terminal is connected to a signal line in the display portion, a second conduction terminal is connected to a pixel electrode in the display portion, that is to be applied with a voltage in accordance with an image to be displayed, and a channel layer is formed of an oxide semiconductor.

According to a sixth aspect of the present invention, there is provided a method for driving a display device having a display portion which includes a plurality of pixel formation portions, a drive portion which drives the display portion, and a display control portion which controls the drive portion based on data received from the outside, the method including: a step of performing an alternating current drive; and a transition step of providing a transition period including a period, in which the display portion is to be driven based on at least one refresh rate taking a value between a first value and a second value, between a first drive period in which the display portion is to be driven based on the first value and a second drive period in which the display portion is to be driven based on the second value in the case of switching a refresh rate, which is decided in accordance with a proportion of a refresh period for refreshing a screen of the display portion and a non-refresh period for pausing the refresh of the screen, from the first value to the second value, wherein in the transition step, a positive polarity period made up of a refresh period in which a refresh is performed in a positive polarity and a non-refresh period immediately after the refresh period and a negative polarity period made up of a refresh period in which a refresh is performed in a negative polarity and a non-refresh period immediately after the refresh period are provided in substantially the same proportion as each other.

According to a seventh aspect of the present invention, in the sixth aspect of the present invention, in the transition step, the positive polarity period and the negative polarity period are provided in substantially the same proportion as each other with respect to each refresh rate in the transition period.

Effects of the Invention

According to the first aspect of the present invention, in the case of switching a refresh rate from a first value to a second value, a transition period is provided between a first drive period and a second drive period. This transition period includes a period (sub-transition period) in which a drive is to be performed based on at least one kind of refresh rate taking a value between the first value and the second value. Hence the refresh rate gradually changes from the first value to the second value. Since a period in which a pixel potential is to be held gradually changes as the refresh rate gradually changes in such a manner, an amount of change in pixel potential gradually changes. Therefore, for example in the liquid crystal display device, the effective liquid crystal voltage gradually changes at the time of the refresh rate being switched from the first value to the second value. Accordingly, even when a difference between the first value and the second value is relatively large, namely when the refresh rate is to be switched on a large scale, it is possible to make a change in display luminance small, so as to suppress the deterioration in display quality. Further, in the whole of the transition period, the positive polarity periods and the negative polarity periods are provided in substantially the same proportion as each other. Therefore, for example in the liquid crystal display device, it is possible to keep DC balance in the transition period, so as to suppress the degradation in liquid crystal. In such a manner as above, it is possible to switch the refresh rate while suppressing the deterioration in display quality and the degradation in liquid crystal.

According to the second aspect of the present invention, a similar effect to that of the first aspect of the present invention can be exerted by providing the positive polarity period and the negative polarity period in substantially the same proportion as each other with respect to each refresh rate in the transition period.

According to the third aspect of the present invention, a potential (common potential) to be commonly given to the plurality of pixel formation portions is set in accordance with the refresh rate. For example, in the liquid crystal display device that performs a polarity reversal drive (alternating current drive), such a common potential (optimum common potential), with which a liquid crystal voltage to be held from a positive-polarity refresh frame (frame in which the refresh is performed at a positive polarity voltage) to the next negative-polarity refresh frame (frame in which the refresh is performed at a negative polarity voltage) is substantially agree with a liquid crystal voltage to be held from the negative-polarity refresh frame to the next positive-polarity refresh frame, generally varies depending on the refresh rate. For this reason, setting such an optimum common potential in accordance with the refresh rate allows reduction in non-uniformity of the liquid crystal voltage which varies depending on the refresh rate. Hence it is possible to further suppress the deterioration in display quality.

According to the fourth aspect of the present invention, in a case where the second drive period is forcibly switched to the first drive period immediately after image data has been received from the outside in the second drive period, a change in display luminance at the time of resuming the second drive period can be made small. Hence it is possible to suppress the deterioration in display quality.

According to the fifth aspect of the present invention, a thin-film transistor in which a channel layer is formed of an oxide semiconductor is used as a thin-film transistor in the pixel formation portion. Hence it is possible to sufficiently hold a voltage written in the pixel formation portion. It is possible to make the change in display luminance still smaller, so as to further suppress the deterioration in display quality.

According to the sixth aspect or the seventh aspect of the present invention, a similar effect to that of the first aspect or the second aspect of the present invention can be exerted in a method for driving the display device.

BRIEF DESCRIPTION OF THE DRAWINGS

FIG. 13(A) is a signal waveform diagram showing a pixel potential in the case of the refresh rate being 60 Hz, and FIG. 13(B) is a signal waveform diagram showing a pixel potential in the case of the refresh rate being 1 Hz.

MODES FOR CARRYING OUT THE INVENTION

Hereinafter, first to fourth embodiments of the present invention will be described with reference to the attached drawings. "One frame" in each of the embodiments below means one frame (16.67 ms) in a general display device with a refresh rate of 60 Hz. Further, in the following, a period with a refresh rate of X Hz (X>0) is referred to as an "X-Hz period". Moreover, in the following, a symbol concerning a voltage or a potential may itself denotes a magnitude of the voltage or the potential.

<1. First Embodiment>

<1.1 Overview of Whole Configuration and Operation>

Figure 1:
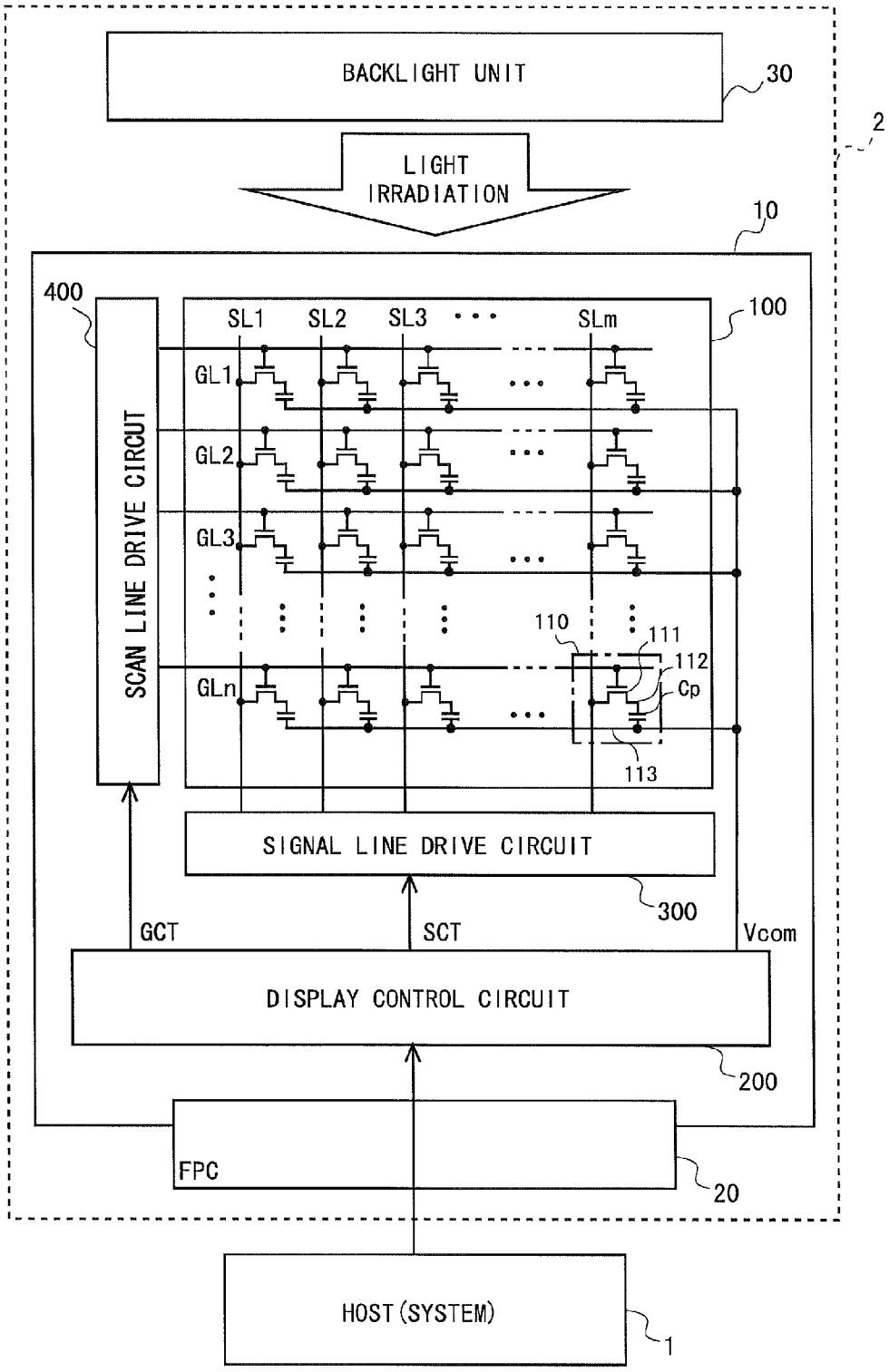
FIG. 1 is a block diagram showing a configuration of a liquid crystal display device according to a first embodiment of the present invention.

FIG. 1 is a block diagram showing a configuration of a liquid crystal display device 2 according to the first embodiment of the present invention. As shown in FIG. 1, a liquid crystal display panel 10 and a backlight unit 30 are provided. An FPC (Flexible Printed Circuit) 20 for external connection is provided on the liquid crystal display panel 10. Further, a display portion 100, a display control circuit 200, a signal line drive circuit 300 and a scan line drive circuit 400 are provided on the liquid crystal display panel 10. It is to be noted that both or either of the signal line drive circuit 300 and the scan line drive circuit 400 may be provided in the display control circuit 200. Moreover, both or either of the signal line drive circuit 300 and the scan line drive circuit 400 may be formed integrally with the display portion 100. A host 1 (system) mainly configured of a CPU is provided outside the liquid crystal display device 2.

The display portion 100 is formed with a plurality of (m) signal lines SL1 to SLm, a plurality of (n) scan lines GL1 to GLn, and a plurality of (m×n) pixel formation portions 110 provided corresponding to intersections of m-signal lines SL1 to SLm and n-scan lines GL1 to GLn. Hereinafter, the m-signal lines SL1 to SLm are simply referred to as "signal lines SL" in the case of not distinguishing them, and the n-scan lines GL1 to GLn are simply referred to as "scan lines GL" in the case of not distinguishing them. The m×n-pixel formation portions 110 are formed in matrix. Each of the pixel formation portions 110 is configured of: a TFT 111 in which the scan line GL passing through the corresponding intersection is connected with a gate terminal as a control terminal and the signal line SL passing through the corresponding intersection is connected with a source terminal as a first conduction terminal; a pixel electrode 112 connected to a drain terminal as a second conduction terminal of the TFT 111; a common electrode 113 provided commonly to the m×n pixel formation portions 110; and a liquid crystal layer interposed between the pixel electrode 112 and the common electrode 113 and provided commonly to the m×n pixel formation portions 110. Then, a pixel capacitance Cp is made up of a liquid crystal capacitance formed of the pixel electrode 112 and the common electrode 113. It is to be noted that, typically, an auxiliary capacitance is provided in parallel with the liquid crystal capacitance in order to reliably hold a voltage in the pixel capacitance Cp, and hence the pixel capacitance Cp is practically made up of the liquid crystal capacitance and the auxiliary capacitance.

In the present embodiment, a TFT (hereinafter referred to as "oxide TFT") using an oxide semiconductor for a channel layer is used as the TFT 111. More specifically, the channel layer of the TFT 111 is formed of IGZO (InGaZnOx) mainly composed of indium (In), gallium (Ga), zinc (Zn) and oxygen (O). Hereinafter, a TFT using IGZO for the channel layer is referred to as an "IGZO-TFT". The IGZO-TFT has a much smaller off-leakage current as compared with a silicon-system TFT using amorphous silicon or the like for the channel layer. Hence it is possible to hold a voltage written in the pixel capacitance Cp for a longer period. In addition, a similar effect can also be obtained when oxide semiconductor containing at least one of indium, gallium, zinc, copper (Cu), silicon (Si), tin (Sn), aluminum (Al), calcium (Ca), germanium (Ge) and lead (Pb), for example, is used for the channel layer as oxide semiconductor other than IGZO. Further, using the oxide TFT as the TFT 111 is a mere example, and instead of this, the silicon-type TFT may be used.

The display control circuit 200 is typically realized as an IC (Integrated Circuit). The display control circuit 200 receives data DAT from the host 1 via the FPC 20, and in accordance with this, it generates and outputs a signal line control signal SCT, the scan line control signal GCT, and a common potential Vcom. The signal line control signal SCT is given to the signal line drive circuit 300. The scan line control signal GCT is given to the scan line drive circuit 400. The common potential Vcom is given to the common electrode 113. In the present embodiment, transmission and reception of data DAT between the host 1 and the display control circuit 200 are performed via an interface conforming to the DSI (Display Serial Interface) standard proposed by the MIPI (Mobile Industry Processor Interface) Alliance. Data can be transmitted at high speed by means of this interface conforming to the DSI standard. In the present embodiment, a video mode or a command mode of the interface conforming to the DSI standard is used.

The signal line drive circuit 300 generates and outputs a driving video signal to be given to the signal line SL in accordance with the signal line control signal SCT. The signal line control signal SCT includes a digital video signal corresponding to RGB data RGBD, a source start pulse signal, a source clock signal, a latch strobe signal, and the like, for example. The signal line drive circuit 300 activates a shift register, a sampling latch circuit and the like therein, which are not shown, in accordance with the source start pulse signal, the source clock signal and the latch strobe signal, and converts a digital signal obtained based on the digital video signal to an analog signal in a DA conversion circuit, not shown, to generate a driving video signal.

The scan line drive circuit 400 repeats application of an active scan signal to the scan line GL at a predetermined cycle in accordance with the scan line control signal GCT. The scan line control signal GCT includes a gate clock signal and a gate start pulse signal, for example. The scan line drive circuit 400 activates a shift register and the like therein, which are not shown, in accordance with the gate start pulse signal and the gate clock signal, to generate a scan signal.

The backlight unit 30 is provided on the rear surface side of the liquid crystal display panel 10, and irradiates the rear surface of the liquid crystal display panel 10 with backlight. The backlight unit 30 typically includes a plurality of LEDs (Light Emitting Diodes). The backlight unit 30 may be one controlled by the display control circuit 200, or may be one controlled by some other method. It is to be noted that, when the liquid crystal display panel 10 is a reflection type, there is no need for providing the backlight unit 30.

As thus described, the driving video signal is applied to the signal line SL, the scan signal is applied to the scan line GL, and the backlight unit 30 is driven, whereby a screen in accordance with image data transmitted from the host 1 is displayed on the display portion 100 of the liquid crystal display panel 10.

<1.2 Configuration of Display Control Circuit>

Hereinafter, the configuration of the display control circuit 200 will be described by dividing it into three aspects. A first aspect is an aspect of using a video mode and not providing a RAM (Random Access Memory). Hereinafter, such a first aspect is referred to as a "video mode RAM-through". A second aspect is an aspect of using a video mode and providing the RAM. Hereinafter, such a second aspect is referred to as a "video mode RAM-captured". A third aspect is an aspect of using a command mode and providing the RAM. Hereinafter, such a third aspect is referred to as a "command mode RAM-write". In addition, since the present invention is not restricted to the interface conforming to the DSI standard, the configuration of the display control circuit 200 is not restricted to the three kinds of aspects described here.

<1.2.1 Video Mode RAM-Through>

Figure 2:
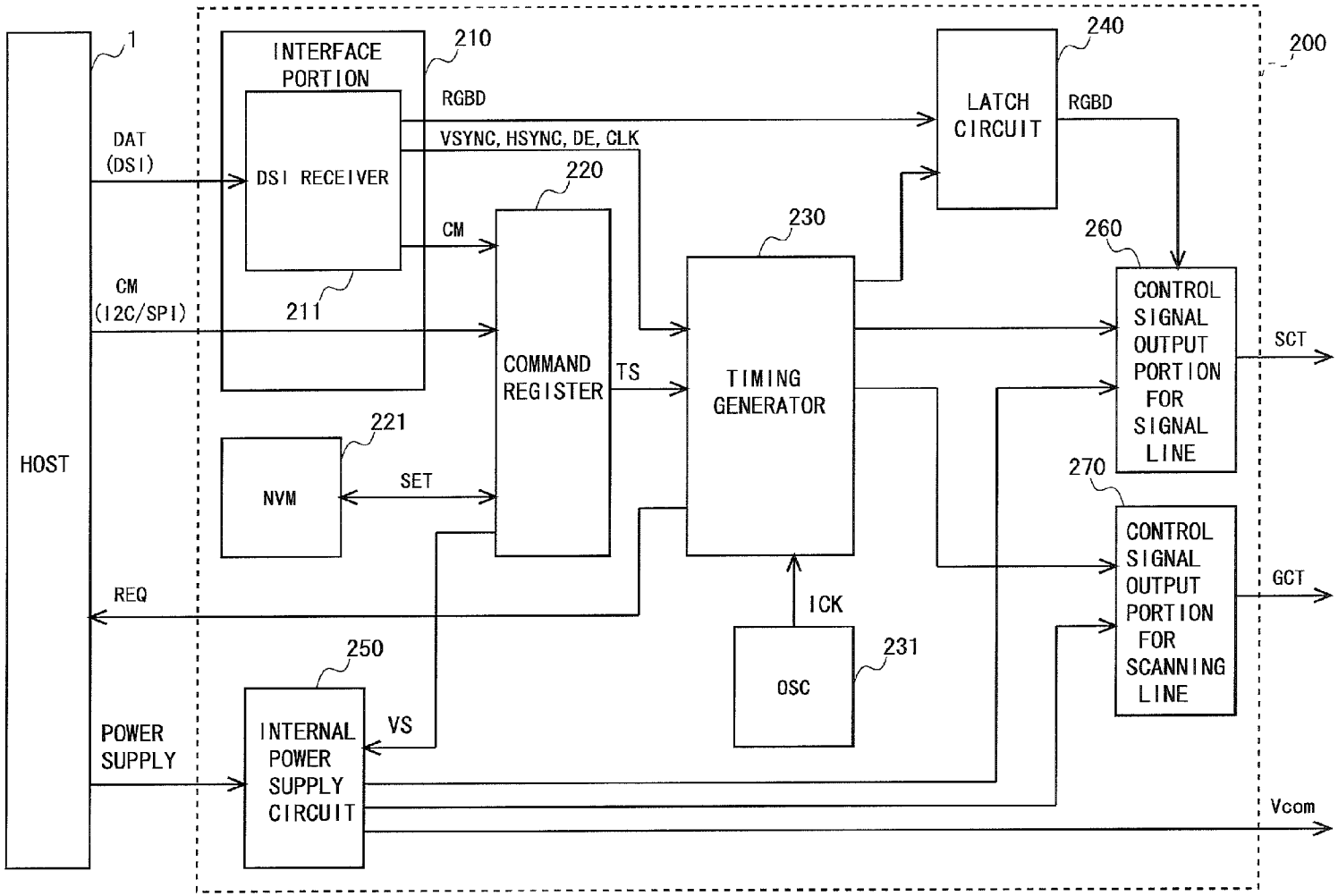
FIG. 2 is a block diagram showing a configuration of a display control circuit adapted to a video mode RAM-through in the first embodiment.

FIG. 2 is a block diagram showing a configuration of the display control circuit 200 adapted to the video mode RAM-through (hereinafter referred to as "display control circuit 200 in the video mode RAM-through") in the present embodiment. As shown in FIG. 2, the display control circuit 200 is configured of an interface portion 210, a command register 220, an NVM (Non-Volatile Memory) 221, a timing generator 230, an OSC (oscillator) 231, a latch circuit 240, an internal power supply circuit 250, a control signal output portion for signal line 260, and a control signal output portion for scanning line 270. The interface portion 210 includes a DSI receiver 211. It is to be noted that both or either of the signal line drive circuit 300 and the scan line drive circuit 400 may be provided in the display control circuit 200 as described above.

The DSI receiver 211 in the interface portion 210 conforms to the DSI standard. The data DAT in the video mode includes RGB data RGBD that shows data concerning an image, a vertical synchronous signal VSYNC and a horizontal synchronous signal HSYNC as synchronous signals, a data enable signal DE, a clock signal CLK, and command data CM. The command data CM includes data concerning a variety of control. Upon receipt of the data DAT from the host 1, the DSI receiver 211 transmits the RGB data RGBD included in the data DAT to the latch circuit 240, transmits the vertical synchronous signal VSYNC, the horizontal synchronous signal HSYNC, the data enable signal DE and the clock signal CLK to the timing generator 230, and transmits the command data CM to the command register 220. It is to be noted that the command data CM may be transmitted from the host 1 to the command register 220 via the interface conforming to the I2C (Inter Integrated Circuit) standard or the SPI (Serial Peripheral Interface) standard. In this case, the interface portion 210 may include a receiver conforming to the I2C standard or the SPI standard.

The command register 220 holds the command data CM. Setting data SET for a variety of control is held in the NVM 221. The command register 220 reads the setting data SET held in the NVM 221, and updates the setting data SET in accordance with the command data CM. In accordance with the command data CM and the setting data SET, the command register 220 transmits a timing control signal TS to the timing generator 230, and transmits a voltage setting signal VS to the internal power supply circuit 250.

In accordance with the vertical synchronous signal VSYNC, the horizontal synchronous signal HSYNC, the data enable signal DE, the clock signal CLK and the timing control signal TS, the timing generator 230 transmits a control signal that controls the latch circuit 240, the control signal output portion for signal line 260 and the control signal output portion for scanning line 270 based on an internal clock signal ICK generated in the OSC 231. Further, in accordance with the vertical synchronous signal VSYNC, the horizontal synchronous signal HSYNC, the data enable signal DE, the clock signal CLK and the timing control signal TS, the timing generator 230 transmits to the host 1 a request signal REQ generated based on the internal clock signal ICK that is generated in the OSC 231. The request signal REQ is a signal that requests the host 1 to transmit the data DAT. It is to be noted that the OSC 231 is not essential in the display control circuit 200 in the video mode RAM-through.

The latch circuit 240 transmits the RGB data RGBD for one line to the control signal output portion for signal line 260 based on control of the timing generator 230.

The internal power supply circuit 250 generates and outputs a power supply voltage and the common potential Vcom for use in the control signal output portion for signal line 260 and the control signal output portion for scanning line 270 based on the power supply given from the host 1 and the voltage setting signal VS given from the command register 220.

Based on the RGB data RGBD from the latch circuit 240, the control signal from the timing generator 230 and the power supply voltage from the internal power supply circuit 250, the control signal output portion for signal line 260 generates the signal line control signal SCT and transmits this to the signal line drive circuit 300.

Based on the control signal from the timing generator 230 and the power supply voltage from the internal power supply circuit 250, the control signal output portion for scanning line 270 generates the scan line control signal GCT and transmits this to the scan line drive circuit 400.

<1.2.2 Video Mode RAM-Captured>

Figure 3:
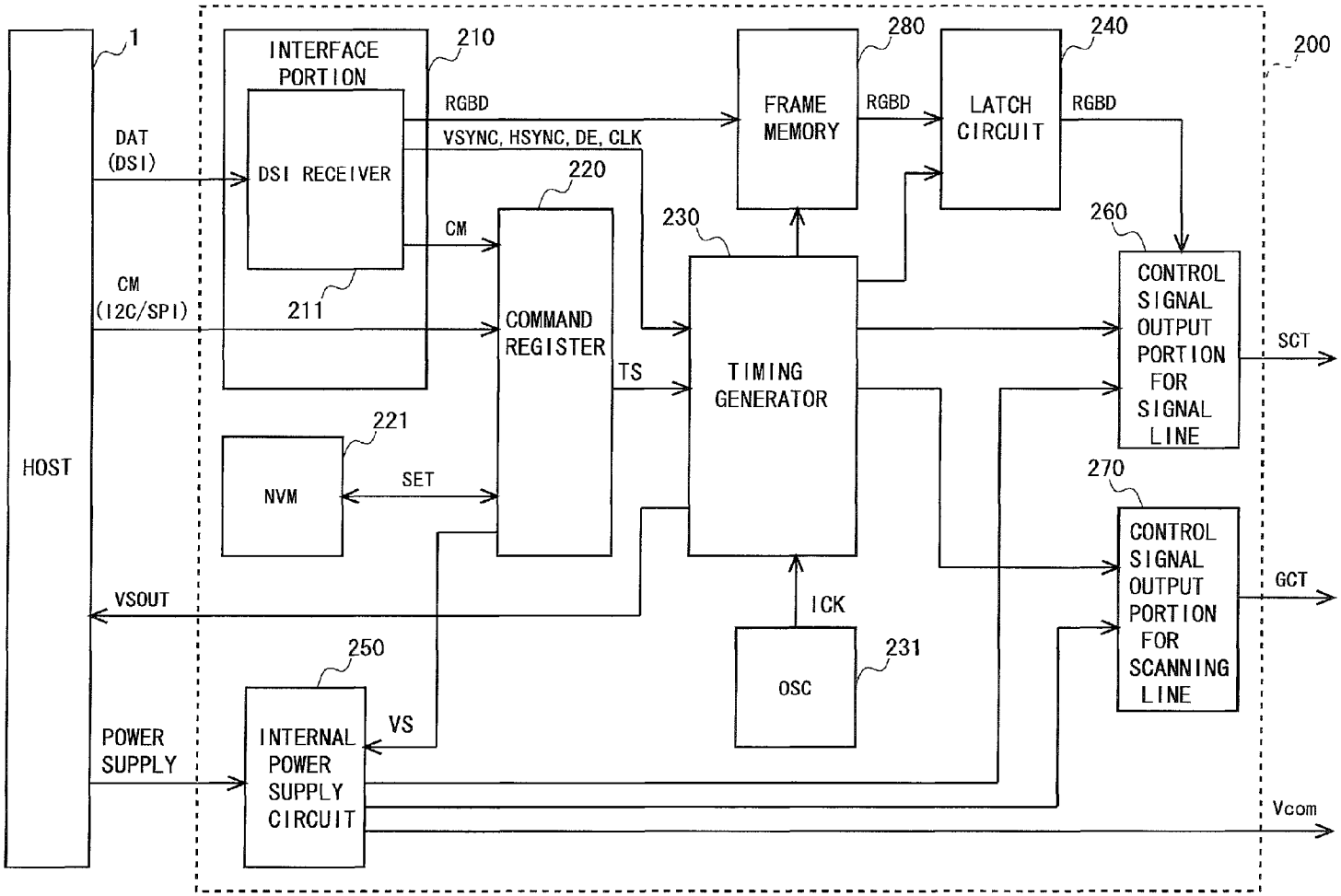
FIG. 3 is a block diagram showing a configuration of a display control circuit adapted to a video mode RAM-captured in the first embodiment.

FIG. 3 is a block diagram showing a configuration of the display control circuit 200 adapted to the video mode RAM-captured (hereinafter referred to as "display control circuit 200 in the video mode RAM-captured") in the present embodiment. As shown in FIG. 3, the display control circuit 200 in the video mode RAM-captured is one formed by adding a frame memory (RAM) 280 to the foregoing display control circuit 200 in the video mode RAM-through.

In the display control circuit 200 in the video mode RAM-through, the RGB data RGBD is directly transmitted from the DSI receiver 211 to the latch circuit 240, but in the display control circuit 200 in the video mode RAM-captured, the RGB data RGBD transmitted from the DSI receiver 211 is held in the frame memory 280. Then, the RGB data RGBD held in the frame memory 280 is read to the latch circuit 240 in accordance with the control signal generated in the timing generator 230. Further, the timing generator 230 transmits a vertical synchronous output signal VSOUT to the host 1 in place of the request signal REQ. The vertical synchronous output signal VSOUT is a signal that controls transmission timing for the data DAT from the host 1 such that the writing timing and reading timing for the RGB data RGBD in and from the frame memory 280 do not overlap. The other configuration and operation of the display control circuit 200 in the video mode RAM-captured are similar to those of the display control circuit 200 in the video mode RAM-through, and hence descriptions thereof are omitted. It is to be noted that the OSC 231 is not essential in the display control circuit 200 in the video mode RAM-captured.

In the display control circuit 200 in the video mode RAM-captured, the RGB data RGBD can be held in the frame memory 280, thus eliminating the need for newly transmitting the data DAT from the host 1 to the display control circuit 200 when the screen is not updated.

<1.2.3 Command Mode RAM-Write>

Figure 4:
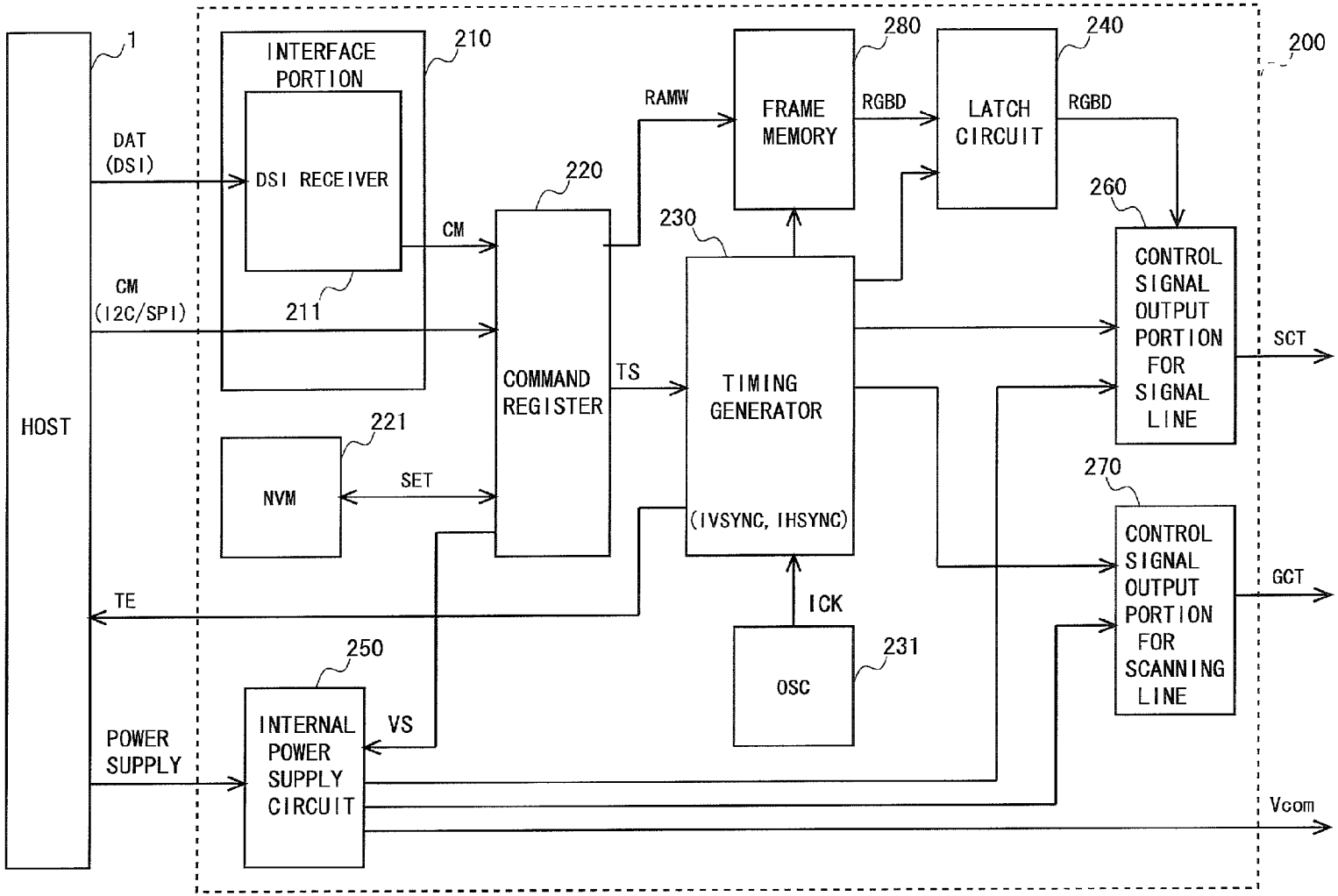
FIG. 4 is a block diagram showing a configuration of a display control circuit adapted to a command mode RAM-write in the first embodiment.

FIG. 4 is a block diagram showing a configuration of the display control circuit 200 adapted to the command mode RAM-write (hereinafter referred to as "display control circuit 200 in the command mode RAM-write") in the present embodiment. As shown in FIG. 4, the display control circuit 200 in the command mode RAM-write has a similar configuration to that of the display control circuit 200 in the video mode RAM-captured, but is different therefrom in the kind of data included in the data DAT.

The data DAT in the command mode includes the command data CM, and does not include the RGB data RGBD, the vertical synchronous signal VSYNC, the horizontal synchronous signal HSYNC, the data enable signal DE and the clock signal CLK. However, the command data CM in the command mode includes data concerning an image and data concerning a variety of timing. The command register 220 transmits, to the frame memory 280, RAM write data RAMW that corresponds to the data concerning an image out of the command data CM. This RAM write data RAMW corresponds to the RGB data RGBD. Further, in the command mode, the timing generator 230 does not receive the vertical synchronous signal VSYNC and the horizontal synchronous signal HSYNC, and thus generates therein an internal vertical synchronous signal IVSYNC and an internal horizontal synchronous signal IHSYNC, which correspond to the above signals, based on the internal clock signal ICK and the timing control signal TS. The timing generator 230 controls the latch circuit 240, the control signal output portion for signal line 260 and the control signal output portion for scanning line 270 based on the internal vertical synchronous signal IVSYNC and the internal horizontal synchronous signal IHSYNC. Moreover, the timing generator 230 transmits to the host 1 a transmission control signal TE corresponding to the above vertical synchronous output signal VSOUT.

<1.3 Operation>

Figure 5:
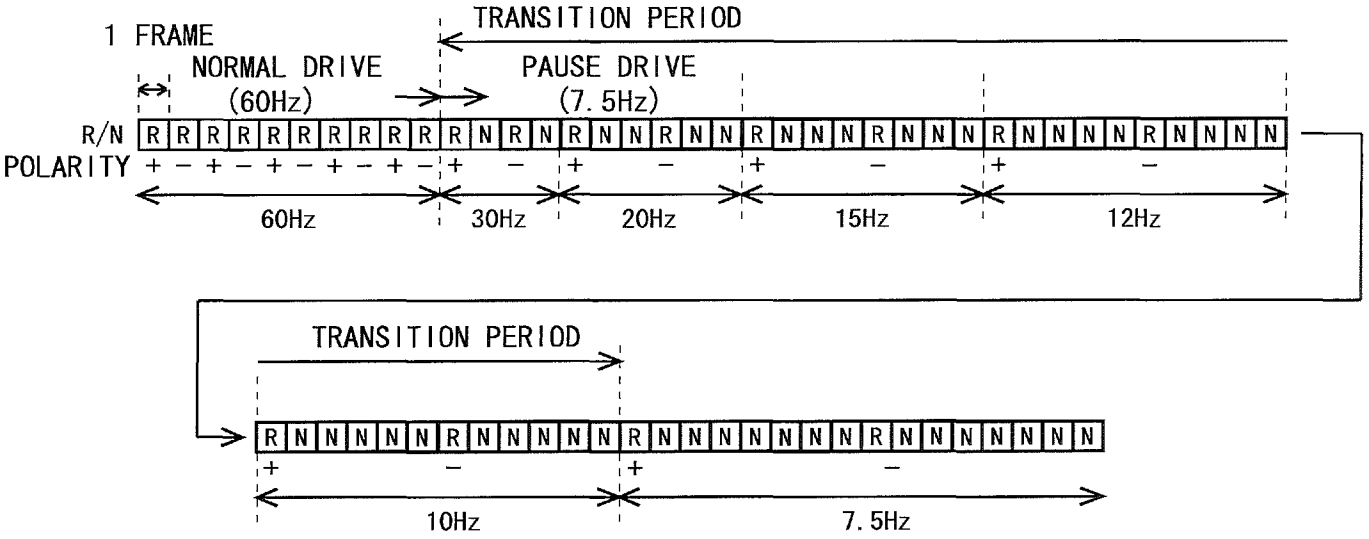
FIG. 5 is a diagram for explaining one example of an operation of the liquid crystal display device according to the first embodiment.

FIG. 5 is a diagram for explaining one example of an operation of the liquid crystal display device 2 according to the present embodiment. In the example shown in FIG. 5, there are performed two kinds of drives, a normal drive with a refresh rate of 60 Hz, and a pause drive with a refresh rate of not higher than 60 Hz (e.g., 7.5 Hz, etc.). It should be noted that the drives that will be described below are basically similar in any of the video mode RAM-through, the video mode RAM-captured and the command mode RAM-write. Here, the normal drive in the present embodiment means a drive that refreshes the screen in each frame. Further, the pause drive in the present embodiment means a drive that is provided with a frame (hereinafter referred to as "refresh frame") in which the screen is refreshed, and thereafter provided with a frame (hereinafter referred to as "non-refresh frame) in which the refresh of the screen is paused, and alternately repeats the refresh frames and the non-refresh frames at every predetermined number of frames. Each rectangular box in FIG. 5 shows one frame, the refresh frame is denoted by "R", and the non-refresh frame is denoted by "N". Moreover, in the present embodiment, a polarity reversal drive (alternating current drive) is performed, and a polarity of a voltage at which the refresh is performed in each refresh frame is shown under the frame in FIG. 5. "+" indicates a positive polarity, and "−" indicates a negative polarity. Hereinafter, a refresh frame in which the refresh is performed at a positive polarity voltage is referred to as a "positive-polarity refresh frame", and a refresh frame in which the refresh is performed at a negative polarity voltage is referred to as a "negative-polarity refresh frame".

In the refresh frame, the screen is refreshed as described above. More specifically, while a driving video signal is supplied from the signal line drive circuit 300 to the signal lines SL1 to SLm in accordance with the signal line control signal SCT that includes a digital video signal corresponding to the RGB data RGBD, the scan lines GL1 to GLn are scanned (sequentially selected) by the scan line drive circuit 400 in accordance with the scan line control signal GCT. The TFT 111 corresponding to the selected scan line GL is brought into an on-state, and a voltage of the driving video signal is written in the pixel capacitance Cp. In such a manner, the screen is refreshed. Subsequently, the TFT 111 comes into an off-state, and the written voltage, namely the liquid crystal voltage Vlc, is held until the screen is refreshed next time.

In the non-refresh frame, the refresh of the screen is paused as described above. More specifically, the supply of the scan line control signal GCT to the scan line drive circuit 400 is paused, or the scan line control signal GCT becomes a fixed potential, thereby leading to pausing of the operation of the scan line drive circuit 400, and hence the scan lines GL1 to GLn are not scanned. That is, in the non-refresh frame, the voltage of the driving video signal is not written in the pixel capacitance Cp. However, with the liquid crystal voltage Vlc being held as described above, the screen refreshed in the immediate previous refresh frame continues to be displayed. Further, in the non-refresh frame, the supply of the signal line control signal SCT to the signal line drive circuit 300 is paused, or the signal line control signal SCT becomes a fixed potential, thereby leading to pausing of the operation of the signal line drive circuit 300. In the non-refresh frame, since the operations of the scan line drive circuit 400 and the signal line drive circuit 300 are paused as thus described, it is possible to reduce power consumption. However, the signal line drive circuit 300 may be made operated. In this case, a predetermined fixed potential is desirably outputted as the driving video signal.

Here, a description will be given of a constitutional example of the frame with the refresh rate illustrated in the present specification. When the refresh rate is 60 Hz, the refresh frame is repeated and the non-refresh frame is not provided. When the refresh rate is 30 Hz, one non-refresh frame is provided immediately after one refresh frame. When the refresh rate is 20 Hz, two non-refresh frames are provided immediately after one refresh frame. When the refresh rate is 15 Hz, three non-refresh frames are provided immediately after one refresh frame. When the refresh rate is 12 Hz, four non-refresh frames are provided immediately after one refresh frame. When the refresh rate is 10 Hz, five non-refresh frames are provided immediately after one refresh frame. When the refresh rate is 7.5 Hz, seven non-refresh frames are provided immediately after one refresh frame. When the refresh rate is 6 Hz, nine non-refresh frames are provided immediately after one refresh frame. When the refresh rate is 5 Hz, 11 non-refresh frames are provided immediately after one refresh frame. The lower the refresh frame, the higher the proportion of the non-refresh frame becomes, and hence the reduced amount of power consumption becomes larger.

Data (hereinafter referred to as "rate data") such as the numbers of refresh frames and non-refresh frames at each refresh rate are included in the command data CM, for example. By transmission of the timing control signal TS in accordance with the rate data to the timing generator 230, a drive in accordance with the refresh rate is performed. The refresh rate is switched by, for example, transmission of rate data of the refresh rate after switched from the host 1 to the command register 220 and updating of the rate data held in the command register 220.

As described above, in one example of the operations of the liquid crystal display device 2 according to the present embodiment, switching from the normal drive (60 Hz) to the pause drive (7.5 Hz) is performed. In the conventional display device for performing the pause drive, an amount of change in pixel potential Vp becomes greatly different in the case of an abrupt change in refresh rate, such as the case of switching of the refresh rate from 60 Hz to 7.5 Hz. This results in an abrupt change in effective liquid crystal voltage before and after switching of the refresh rate. For this reason, a display luminance changes before and after switching of the refresh rate even when the same screen is displayed, which can thus bring about deterioration in display quality.

In the present embodiment, for example as shown in FIG. 5, in the case of switching the refresh rate from 60 Hz as a first value to 7.5 Hz as a second value, a transition period for gradually changing the refresh rate from 60 Hz to 7.5 Hz is provided between a 60-Hz period as a first drive period and a 7.5-Hz period as a second drive period. This transition period is configured by sequentially arraying a 30-Hz period, a 20-Hz period, a 15-Hz period, a 12-Hz period and a 10-Hz period from a start point of the transition period. Hence the refresh rate gradually changes from 60 Hz to 7.5 Hz sequentially through 30 Hz, 20 Hz, 15 Hz, 12 Hz and 10 Hz. The 30-Hz period, the 20-Hz period, the 15-Hz period, the 12-Hz period and the 10-Hz period are respectively provided with four frames, six frames, eight frames, 10 frames and 12 frames. Hereinafter, a period in which the drive is performed in each refresh frame in the transition period is referred to as a "sub-transition period".

In such a manner, as the refresh rate gradually changes from 60 Hz to 7.5 Hz sequentially through 30 Hz, 20 Hz, 15 Hz, 12 Hz and 10 Hz, the period in which the pixel potential Vp is to be held gradually becomes longer, and hence the amount of change in pixel potential Vp gradually becomes larger. For this reason, the effective liquid crystal voltage gradually changes as the refresh rate gradually changes.

Further, the refresh frame immediately before the transition period is the negative-polarity refresh frame. In each sub-transition period, two times of refreshes are performed, and the polarity is reversed in each time of refresh. The first and second frames in the 30-Hz period are respectively the positive-polarity refresh frame and non-refresh frame, and the third and fourth frames are ones obtained by reversing the polarities of these frames. The first to third frames in the 20-Hz period are respectively the positive-polarity refresh frame, non-refresh frame and non-refresh frame, and the fourth to sixth frames are ones obtained by reversing the polarities of these frames. The first to fourth frames in the 15-Hz period are respectively the positive-polarity refresh frame, non-refresh frame, non-refresh frame and non-refresh frame, and the fifth to eighth frames are ones obtained by reversing the polarities of these frames. The first to fifth frames in the 12-Hz period are respectively the positive-polarity refresh frame, non-refresh frame, non-refresh frame, non-refresh frame and non-refresh frame, and the sixth to tenth frames are ones obtained by reversing the polarities of these frames. The first to sixth frames in the 10-Hz period are respectively the positive-polarity refresh frame, non-refresh frame, non-refresh frame, non-refresh frame, non-refresh frame and non-refresh frame, and the seventh to twelfth frames are ones obtained by reversing the polarities of these frames. It is to be noted that, when the refresh frame immediately before the transition period is the positive-polarity refresh frame, the polarity in each sub-transition period, for example, is a reversed one.

As thus described, in the transition period of the example shown in FIG. 5, the number of positive-polarity frames (referring to the positive-polarity refresh frame and the non-refresh frames that follow) and the number of negative-polarity frames (referring to the negative-polarity refresh frame and the non-refresh frames that follow) in the 30-Hz period are respectively two, the number of positive-polarity frames and the number of negative-polarity frames in the 20-Hz period are respectively three, the number of positive-polarity frames and the number of negative-polarity frames are respectively four in the 15-Hz period, the number of positive-polarity frames and the number of negative-polarity frames are respectively five in the 12-Hz period, and the number of positive-polarity frames and the number of negative-polarity frames are respectively six in the 10-Hz period. Hence the number of positive-polarity frames and the number of negative-polarity frames are respectively 20 in the whole of the transition period, and are equal to each other.

In addition, for example in the case of changing the refresh rate from 7.5 Hz as the first value to 60 Hz as the second value, a transition period in which the sequence of the sub-transition periods shown in FIG. 5 is reversed may be provided.

Figure 6:
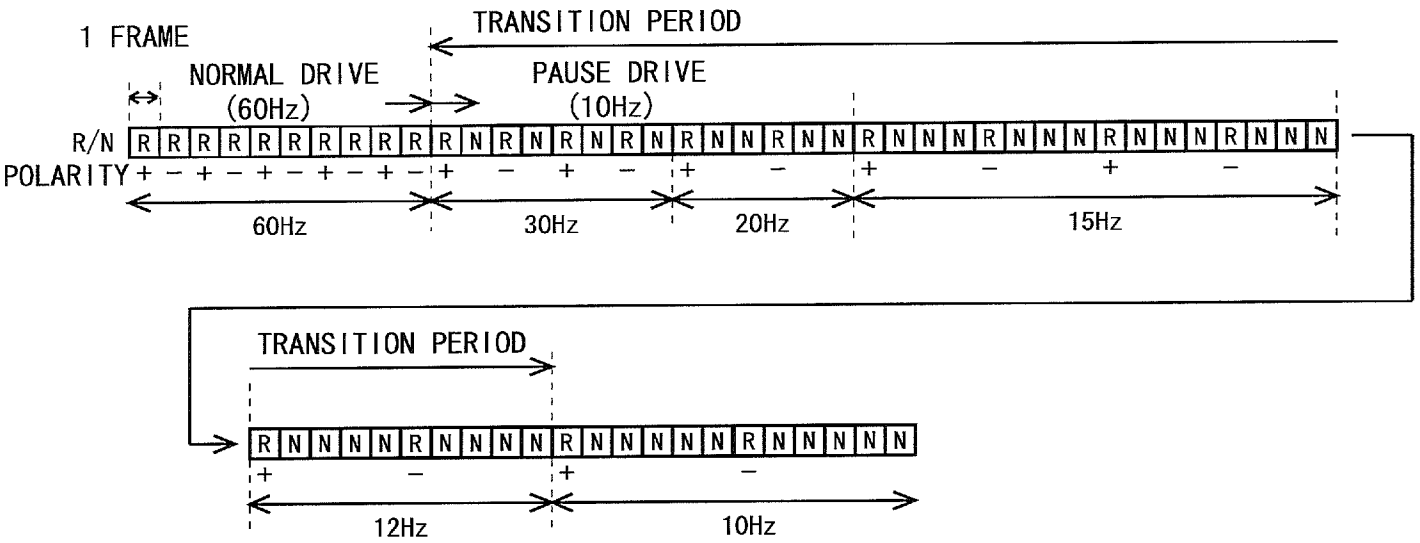
FIG. 6 is a diagram for explaining one example of the operation of the liquid crystal display device according to the first embodiment.

FIG. 6 is a diagram for explaining another example of the operation of the liquid crystal display device according to the present embodiment. In the example shown in FIG. 6, in the case of changing the refresh rate from 60 Hz as the first value to 10 Hz as the second value, a transition period for gradually changing the refresh rate from 60 Hz to 10 Hz is provided between the 60-Hz period as the first drive period and the 10-Hz period as the second drive period. This transition period is configured by sequentially arraying the 30-Hz period, the 20-Hz period, the 15-Hz period and the 12-Hz period from a start point of the transition period. Hence the refresh rate gradually changes from 60 Hz to 10 Hz sequentially through 30 Hz, 20 Hz, 15 Hz and 12 Hz. The 30-Hz period, the 20-Hz period, the 15-Hz period and the 12-Hz period are respectively provided with eight frames, six frames, 16 frames and 10 frames.

In such a manner, as the refresh rate gradually changes from 60 Hz to 10 Hz sequentially through 30 Hz, 20 Hz, 15 Hz and 12 Hz, the period in which the pixel potential Vp is to be held gradually becomes longer, and hence the amount of change in pixel potential Vp gradually becomes larger. For this reason, the effective liquid crystal voltage gradually changes as the refresh rate gradually changes.

Further, the refresh frame immediately before the transition period is the negative-polarity refresh frame. Four times of refreshes are performed in each of the 30-Hz period and the 15-Hz period, and two times of refreshes are performed in the 20-Hz period and the 12-Hz period, while the polarity is reversed in each time of refresh. The first and second frames in the 30-Hz period are respectively the positive-polarity refresh frame and non-refresh frame, and the third and fourth frames are ones obtained by reversing the polarities of these frames. Further, the fifth to eighth frames in the 30-Hz period are similar to the first to fourth frames. The first to third frames in the 20-Hz period are respectively the positive-polarity refresh frame, non-refresh frame and non-refresh frame, and the fourth to sixth frames are ones obtained by reversing the polarities of these frames. The first to fourth frames in the 15-Hz period are respectively the positive-polarity refresh frame, non-refresh frame, non-refresh frame and non-refresh frame, and the fifth to eighth frames are ones obtained by reversing the polarities of these frames. Further, the ninth to sixteenth frames in the 15-Hz period are similar to the first to eighth frames. The first to fifth frames in the 12-Hz period are respectively the positive-polarity refresh frame, non-refresh frame, non-refresh frame, non-refresh frame and non-refresh frame, and the sixth to tenth frames are ones obtained by reversing the polarities of these frames.

As thus described, in the transition period of the example shown in FIG. 6, the number of positive-polarity frames and the number of negative-polarity frames in the 30-Hz period are respectively four, the number of positive-polarity frames and the number of negative-polarity frames in the 20-Hz period are respectively three, the number of positive-polarity frames and the number of negative-polarity frames in the 15-Hz period are respectively eight, and the number of positive-polarity frames and the number of negative-polarity frames in the 12-Hz period are respectively five. Hence the number of positive-polarity frames and the number of negative-polarity frames are respectively 20 in the whole of the transition period, and are equal to each other.

In addition, for example in the case of changing the refresh rate from 10 Hz as the first value to 60 Hz as the second value, a transition period in which the sequence of the sub-transition periods shown in FIG. 6 is reversed may be provided.

<1.4 Effects>

Figure 7:
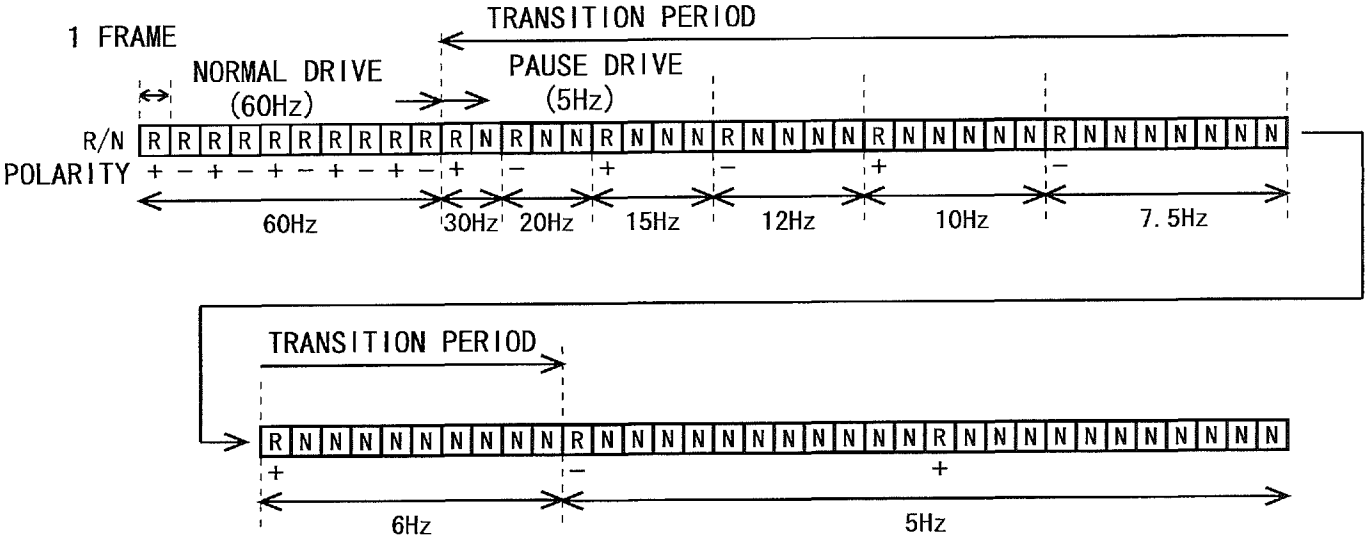
FIG. 7 is a diagram for explaining one example of an operation of the liquid crystal display device in the case of not considering DC balance.

According to the present embodiment, in the case of switching from the normal drive to the pause drive or in the case of switching from the pause drive to the normal drive, there is provided a transition period in which the drive is performed at a refresh rate taking a value between the refresh rate for the normal drive and the refresh rate for the pause drive. For this reason, the refresh rate gradually changes. Since the period in which a pixel potential Vp is to be held gradually changes as the refresh rate gradually changes as thus described, an amount of change in pixel potential Vp gradually changes. Therefore, the effective liquid crystal voltage gradually changes at the time of switching from the normal drive to the pause drive or at the time of switching from the pause drive to the normal drive. Accordingly, even in the case of switching the refresh rate on a large scale, it is possible to make a change in display luminance small, so as to suppress the deterioration in display quality. Further, since the number of positive-polarity frames and the number of negative-polarity frames become equal to each other in each sub-transition period, the number of positive-polarity frames and the number of negative-polarity frames in the whole of the transition period become equal to each other. Hence it is possible to keep DC balance in the transition period, so as to suppress the degradation in liquid crystal. As opposed to this, for example as shown in FIG. 7, in the case of not considering the DC balance in the transition period, (the number of positive-polarity frames is 22 and the number of negative-polarity frames is 16), it is not possible to sufficiently suppress the degradation in liquid crystal. It should be noted that the example of making the number of positive-polarity frames and the number of negative-polarity frames equal to each other in each sub-transition period is not restricted to the example shown here. In such a manner as above, it is possible to switch the refresh rate while suppressing the deterioration in display quality and the degradation in liquid crystal.

Further, according to the present embodiment, the transition period is configured by sequentially arraying a plurality of sub-transition periods such that the refresh rate before switched gradually changes to the refresh rate after switched. For this reason, the change in refresh rate becomes gentler. Hence it is possible to make the change in display luminance still smaller, so as to further suppress the deterioration in display quality.

Moreover, according to the present embodiment, with the IGZO-TFT used as the TFT 111 in the pixel formation portions 110, it is possible to sufficiently hold a voltage written in the pixel capacitance Cp. Hence it is possible to make the change in display luminance still smaller, so as to further suppress the deterioration in display quality.

<1.5 Modified Example>

Figure 8:
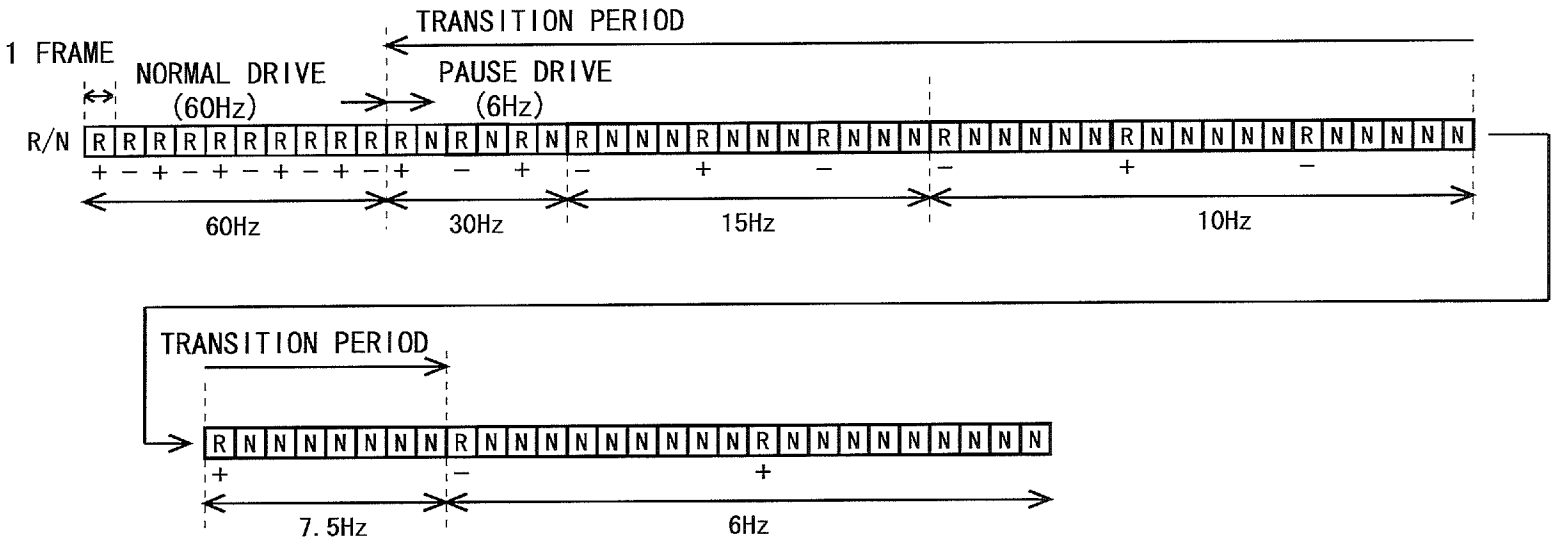
FIG. 8 is a diagram for explaining one example of an operation of a liquid crystal display device according to a modified example of the first embodiment.

FIG. 8 is a diagram for explaining one example of an operation of the liquid crystal display device 2 according to a modified example of the first embodiment of the present invention. In the examples shown in FIGS. 5 and 6, the DC balance is kept in the whole of the transition period by making the number of positive-polarity frames and the number of negative-polarity frames equal to each other in each transition period, but the present invention is not restricted to this. The present modified example is an aspect for keeping the DC balance in the whole of the transition period without making the number of positive-polarity frames and the number of negative-polarity frames equal to each other in each sub-transition period.

In the example shown in FIG. 8, in the case of changing the refresh rate from 60 Hz as the first value to 6 Hz as the second value, a transition period for gradually changing the refresh rate from 60 Hz to 6 Hz is provided between the 60-Hz period as the first drive period and a 6-Hz period as the second drive period. This transition period is configured by sequentially arraying the 30-Hz period, the 15-Hz period, the 10-Hz period and the 7.5-Hz period from a start point of the transition period. The 30-Hz period, the 15-Hz period, the 10-Hz period and the 7.5-Hz period are respectively provided with six frames, 12 frames, 18 frames and eight frames.

The refresh frame immediately before the transition period is the negative-polarity refresh frame. Three times of refreshes are performed in each of the 30-Hz period, the 15-Hz period and the 10-Hz period, and one time of refresh is performed in the 7.5-Hz period. Further, although the polarity is reversed basically in each time of refresh, the polarities in the third refresh in the 15-Hz period and the first refresh in the 10-Hz period are both the negative polarity. The first and second frames in the 30-Hz period are respectively the positive-polarity refresh frame and non-refresh frame, and the third and fourth frames are ones obtained by reversing the polarities of these frames. Further, the fifth and sixth frames are similar to the first and second frames. The first to fourth frames in the 15-Hz period are respectively the negative-polarity refresh frame, non-refresh frame, non-refresh frame and non-refresh frame, and the fifth to eighth frames are ones obtained by reversing the polarities of these frames. The ninth to twelfth frames are similar to the first to fourth frames. The first to sixth frames in the 10-Hz period are respectively the negative-polarity refresh frame, non-refresh frame, non-refresh frame, non-refresh frame, non-refresh frame and non-refresh frame, and the seventh to twelfth frames are ones obtained by reversing the polarities of these frames. The thirteenth to eighteenth frames are similar to the first to sixth frames. The first to eighth frames in the 7.5-Hz period are respectively the negative-polarity refresh frame, non-refresh frame, non-refresh frame, non-refresh frame, non-refresh frame, non-refresh frame, non-refresh frame and non-refresh frame.

As thus described, in the transition period of the example shown in FIG. 8, the number of positive-polarity frames and the number of negative-polarity frames in the 30-Hz period are respectively four and two, the number of positive-polarity frames and the number of negative-polarity frames in the 15-Hz period are respectively four and eight, the number of positive-polarity frames and the number of negative-polarity frames in the 10-Hz period are respectively six and twelve, and the number of positive-polarity frames in the 7.5-Hz period is eight. Hence the number of positive-polarity frames and the number of negative-polarity frames are respectively 22 in the whole of the transition period, and are equal to each other. It is thus possible to keep the DC balance in the transition period similarly to the examples shown in FIGS. 5 and 6.

Figure 9:
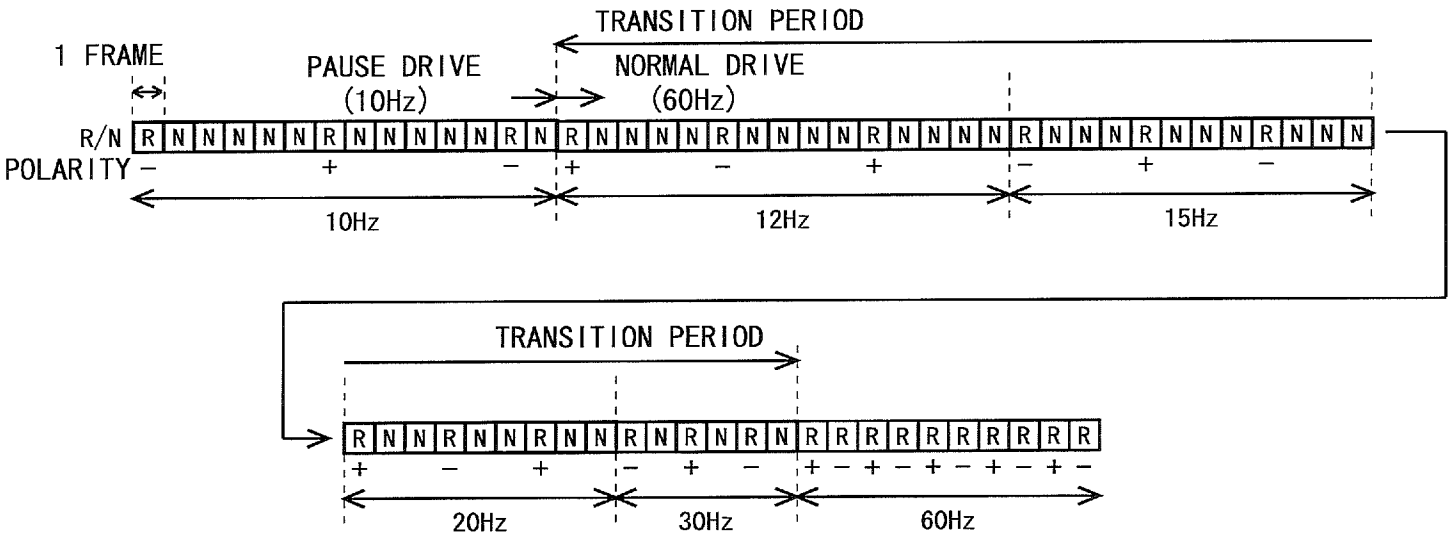
FIG. 9 is a diagram for explaining one example of the operation of the liquid crystal display device according to the modified example of the first embodiment.

FIG. 9 is a diagram for explaining another example of an operation of the liquid crystal display device 2 according to the present modified example. In the case of changing the refresh rate from 10 Hz as the first value to 60 Hz as the second value, a transition period for gradually changing the refresh rate from 10 Hz to 60 Hz is provided between the 10-Hz period as the first drive period and the 60-Hz period as the second drive period. The transition period shown in the example of FIG. 9 is configured by sequentially arraying the 12-Hz period, the 15-Hz period, the 20-Hz period and the 30-Hz period from a start point of the transition period. The 12-Hz period, the 15-Hz period, the 20-Hz period and the 30-Hz period are respectively provided with 15 frames, 12 frames, nine frames and six frames. It is to be noted that in switching from the pause drive (10 Hz) to the normal drive (60 Hz), the 10-Hz period is to be switched to the transition period before the drive of the five non-refresh frames provided after the refresh frame are completed (e.g., at the time of one non-refresh frame being completed) in the 10-Hz period.

The refresh frame immediately before the transition period is the negative-polarity refresh frame. In each sub-transition period, three times of refreshes are performed, and the polarity is reversed in each time of refresh. The first to fifth frames in the 12-Hz period are respectively the positive-polarity refresh frame, non-refresh frame, non-refresh frame, non-refresh frame and non-refresh frame, and the sixth to tenth frames are ones obtained by reversing the polarities of these frames. The eleventh to fifteenth frames are similar to the first to fifth frames. The first to fourth frames in the 15-Hz period are respectively the negative-polarity refresh frame, non-refresh frame, non-refresh frame and non-refresh frame, and the fifth to eighth frames are ones obtained by reversing the polarities of these frames. The ninth to twelfth frames are similar to the first to fourth frames. The first to third frames in the 20-Hz period are respectively the positive-polarity refresh frame, non-refresh frame and non-refresh frame, and the fourth to sixth frames are ones obtained by reversing the polarities of these frames. The seventh to ninth frames are similar to the first to third frames. The first and second frames in the 30-Hz period are respectively the negative-polarity refresh frame and non-refresh frame, and the third and fourth frames are ones obtained by reversing the polarities of these frames. The fifth and sixth frames are similar to the first and second frames.

As thus described, in the transition period of the example shown in FIG. 9, the number of positive-polarity frames and the number of negative-polarity frames in the 12-Hz period are respectively 10 and five, the number of positive-polarity frames and the number of negative-polarity frames in the 15-Hz period are respectively four and eight, the number of positive-polarity frames and the number of negative-polarity frames in the 20-Hz period are respectively six and three, and the number of positive-polarity frames and the number of negative-polarity frames in the 30-Hz period are respectively two and four. Hence the number of positive-polarity frames and the number of negative-polarity frames are respectively 22 and 20 in the whole of the transition period, and they are values close to each other, but not equal. However, considering the negative-polarity frames immediately before the transition period which have been made smaller in number than planned, the number of positive-polarity frames and the number of negative-polarity frames are respectively 22 in the above negative-polarity frames and in the whole of the transition period. Accordingly, also in the example shown in FIG. 9, it is possible to keep the DC balance in the vicinity of the transition period.

<2. Second Embodiment>

<2.1 Operation>

Figure 10:
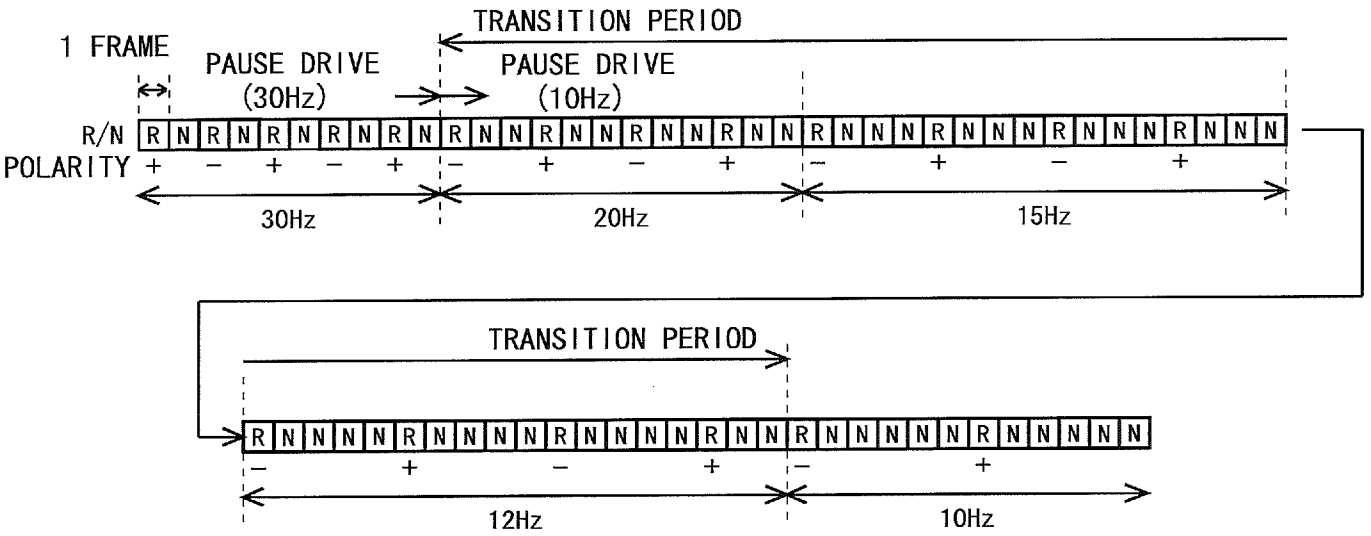
FIG. 10 is a diagram for explaining one example of an operation of a liquid crystal display device according to a second embodiment of the present invention.

FIG. 10 is a diagram for explaining one example of an operation of the liquid crystal display device 2 according to a second embodiment of the present invention. It is to be noted that the present embodiment is basically similar to the first embodiment except for the operation, and hence descriptions of the common portions are omitted. In the above first embodiment and the modified example thereof, the transition period is to be provided in the case of switching from the normal drive to the pause drive or from the pause drive to the normal drive, but in the present embodiment, the transition period is to be provided at the time of switching the refresh rate in the pause drive, as shown in FIG. 10. Here, in the case of changing the refresh rate from 30 Hz as the first value to 10 Hz as the second value, a transition period for gradually changing the refresh rate from 30 Hz to 10 Hz is provided between the 30-Hz period as the first drive period and the 10-Hz period as the second drive period. This transition period is configured by sequentially arraying the 20-Hz period, the 15-Hz period, and the 12-Hz period from a start point of the transition period. The refresh rate gradually changes from 30 Hz to 10 Hz sequentially through 20 Hz, 15 Hz and 12 Hz. The 20-Hz period, the 15-Hz period and the 12-Hz period are respectively provided with 12 frames, 16 frames, and 20 frames.

The refresh frame immediately before the transition period is the positive-polarity refresh frame. In each sub-transition period, two times of refreshes are performed, and the polarity is reversed in each time of refresh as described above. Further, as shown in FIG. 10, the number of positive-polarity frames and the number of negative-polarity frames are equal to each other in each sub-transition period, and it is thus possible to keep the DC balance in the transition period.

<2.2 Effects>

According to the present embodiment, even when the refresh rate is switched in the pause drive, it is possible to exert a similar effect to that of the above first embodiment. It is to be noted that, although the description has been given here by taking the case of lowering the refresh rate as the example, it is also possible to exert a similar effect in the example of increasing the refresh rate (the example of changing 10 Hz to 30 Hz, etc.)

<3. Third Embodiment>

<3.1 Operation>

Figure 11:
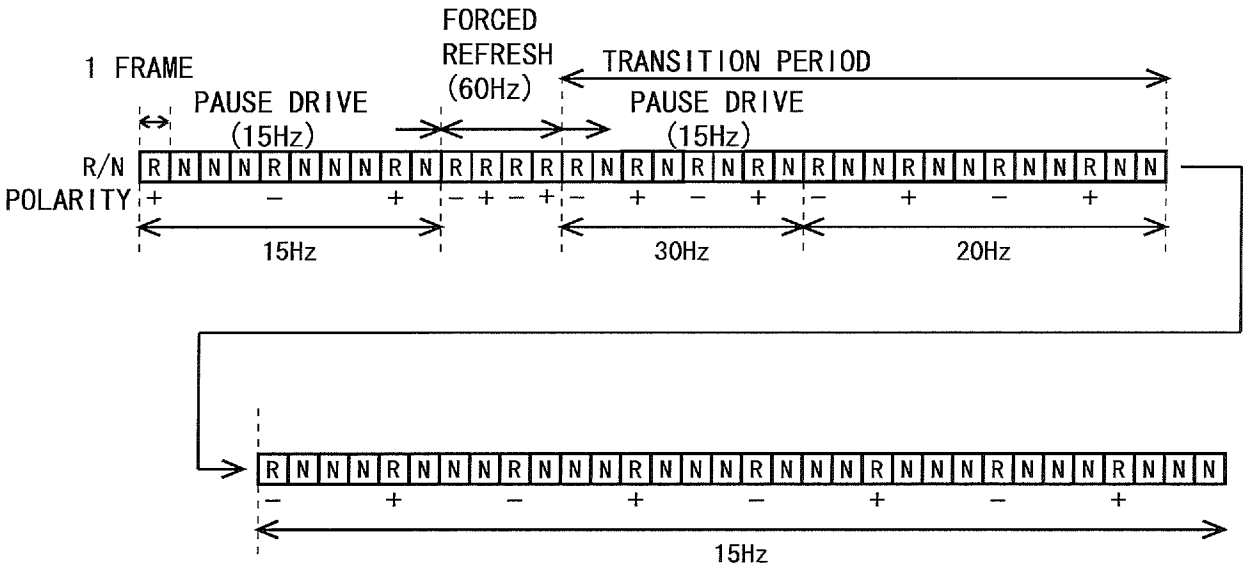
FIG. 11 is a diagram for explaining one example of an operation of a liquid crystal display device according to a third embodiment of the present invention.

FIG. 11 is a diagram for explaining one example of an operation of the liquid crystal display device 2 according to a third embodiment of the present invention. It is to be noted that the present embodiment is basically similar to the first embodiment except for the operation, and hence descriptions of the common portions are omitted. In the present embodiment, a forced refresh is performed during the pause drive (15 Hz) as shown in FIG. 11. Here, the forced refresh means performing a refresh at timing other than previously set timing during the pause drive. This forced refresh is performed in the case of transmitting the data DAT that corresponds to data of the screen to be updated from the host 1 to the display control circuit 200 in the non-refresh frame or in some other case. In the pause drive (15 Hz), three non-refresh frames follow after one refresh frame, but in the example shown in FIG. 11, the forced refresh is started at the point of completion of only one non-refresh frame. In the present embodiment, the refresh is to be performed in four consecutive frames in a period (hereinafter referred to as "forced refresh period") in which the forced refresh is performed. It is to be noted that the number of frames for the forced refresh is not restricted to the example shown here. With the forced refresh period being substantially the 60-Hz period, switching to the 15-Hz period immediately after the forced refresh period can bring about the deterioration in display quality similarly to the case of switching from the normal drive to the pause drive in the conventional liquid crystal display device. Accordingly, in the present embodiment, a transition period is provided after the forced refresh.

In the example shown in FIG. 11, in the case of changing the refresh rate from 60 Hz (refresh rate in the forced refresh period) as the first value to 15 Hz as the second value, a transition period for gradually changing the refresh rate from 60 Hz to 15 Hz is provided between the forced refresh period as the first drive period and the 15-Hz period as the second drive period. This transition period is configured by sequentially arraying the 30-Hz period and the 20-Hz period from a start point of the transition period. Hence the refresh rate gradually changes from 60 Hz to 15 Hz sequentially through 30 Hz and 20 Hz. The 30-Hz period and the 20-Hz period are respectively provided with eight frames and 12 frames.

The refresh frame immediately before the transition period is the positive-polarity refresh frame. In each sub-transition period, four times of refreshes are performed, and the polarity is reversed in each time of refresh as described above. Further, as shown in FIG. 11, the number of positive-polarity frames and the number of negative-polarity frames are equal to each other in each sub-transition period, and it is thus possible to keep the DC balance in the transition period.

<3.2 Effects>

According to the present embodiment, in the aspect of performing the forced refresh during the pause drive, it is possible to make the change in display luminance small at the time of resuming the pause drive after the forced refresh, so as to suppress the deterioration in display quality.

<4. Fourth Embodiment>

<4.1 Optimum Common Potential>

By the pixel potential Vp changing after the refresh of the screen, the liquid crystal voltage Vlc to be held from the positive-polarity refresh frame to the next negative-polarity refresh frame and the liquid crystal voltage Vlc to be held from the negative-polarity refresh frame to the next positive-polarity refresh frame become non-uniform. Further, as described above, the amount of change in pixel potential Vp varies depending on the refresh rate, and hence such non-uniformity is to vary depending on the refresh rate. That is, assuming that the common potential Vcom is uniform in each refresh rate, the non-uniformity between the liquid crystal voltage Vlc to be held from the positive-polarity refresh frame to the next negative-polarity refresh frame and the liquid crystal voltage Vlc to be held from the negative-polarity refresh frame to the next positive-polarity refresh frame is to vary depending on the refresh rate. It should be noted that in the present specification, the common potential Vcom, which takes such a value that the liquid crystal voltage Vlc to be held from the positive-polarity refresh frame to the next negative-polarity refresh frame and the liquid crystal voltage Vlc to be held from the negative-polarity refresh frame to the next positive-polarity refresh frame substantially agree, is referred to as an "optimum common potential". Such an optimum common potential is set in the fourth embodiment of the present invention.

Figure 12:
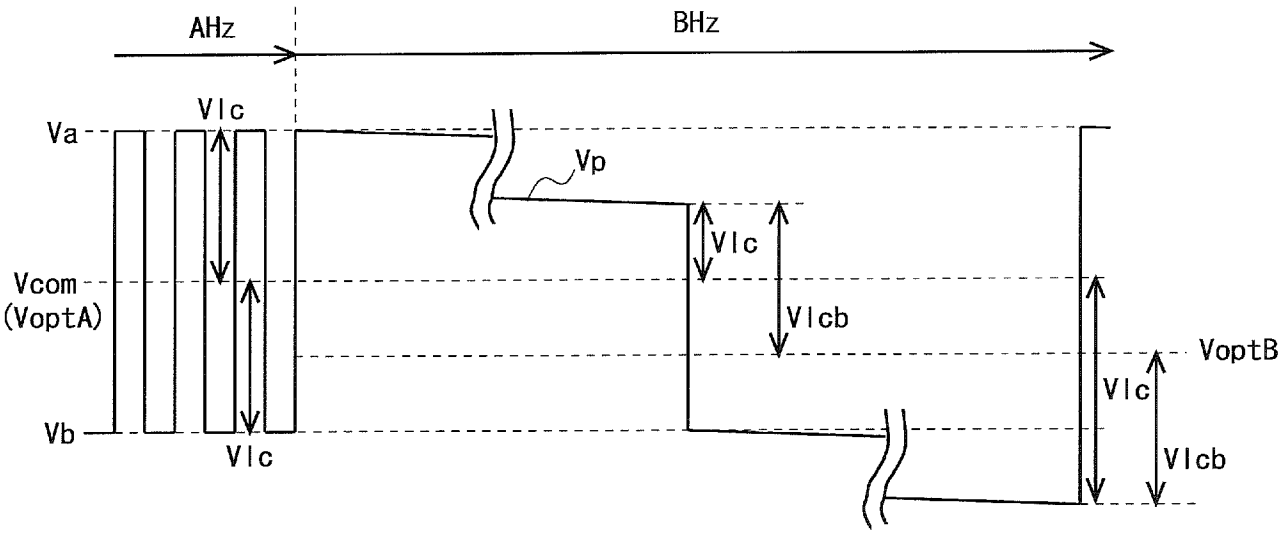
FIG. 12 is a signal waveform diagram for explaining an optimum common potential that is set in a fourth embodiment of the present invention.
Figure 13:
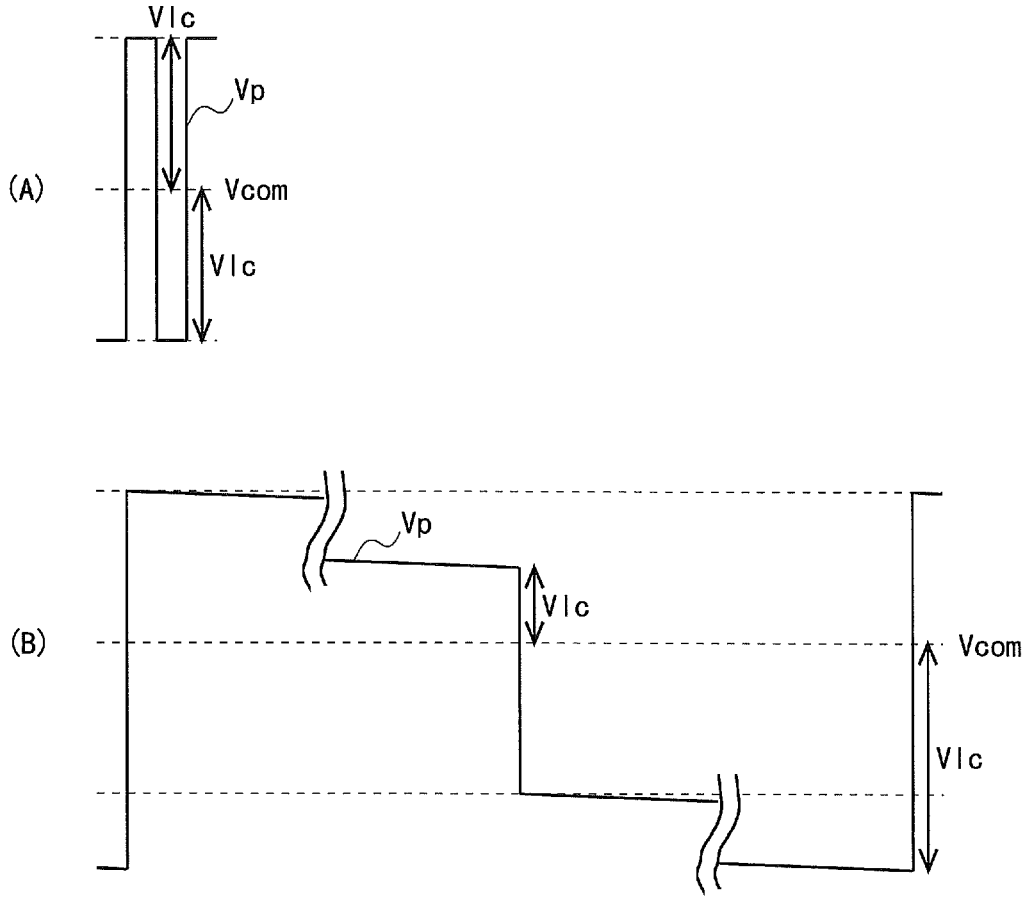
FIGS. 13(A) and 13(B) are signal waveform diagrams showing a situation in which a pixel potential varies depending on a refresh rate, where

FIG. 12 is a signal waveform diagram for explaining the optimum common potential that is set in the present embodiment. Here, a description will be given by taking an A-Hz period and a B-Hz period as examples (A>B>0). The maximum value that the pixel potential Vp can take in the positive-polarity refresh frame is denoted by Va, and the minimum value that the pixel potential Vp can take in the negative-polarity refresh frame is denoted by Vb. Here, Vcom=(Va+Vb)/2. Assuming that the change in optimum pixel potential Vp hardly occurs in the A-Hz period, this Vcom becomes an optimum common potential VoptA in the A-Hz period. On the other hand, since the change in pixel potential Vp becomes larger in the B-Hz period with the refresh rate being lower than that of the A-Hz period, assuming that the common potential is the same value as that in the A-Hz period as shown in FIG. 12, the non-uniformity between the liquid crystal voltage Vlc to be held from the positive-polarity refresh frame to the next negative-polarity refresh frame and the liquid crystal voltage Vlc to be held from the negative-polarity refresh frame to the next positive-polarity refresh frame increases. As thus described, an optimum common potential VoptB in the B-Hz period is different from the optimum common potential VoptA in the A-Hz period (e.g., VoptA>VoptB).

Therefore, in the present embodiment, the common potential is set to the optimum common potential of the refresh rate in accordance with the refresh rate. Data of the optimum common potential of each refresh rate is included in the setting data SET held in the NVM 221, for example. The voltage setting signal VS corresponding to the optimum common potential is transmitted to the internal power supply circuit 250 in accordance with the refresh rate, whereby the optimum common potential is given to the common electrode 113. It should be noted that switching timing for the optimum common potential need not be simultaneous with switching timing for the refresh rate, and may be a predetermined period before and after the switching timing for the refresh rate. Setting such an optimum common potential in accordance with the refresh rate allows reduction in non-uniformity of the liquid crystal voltage Vlc which varies depending on the refresh rate.

<4.2 Effects>

According to the present embodiment, with such an optimum common potential being set in accordance with each refresh rate, it is possible to reduce the non-uniformity of the liquid crystal voltage Vlc which varies depending on the refresh rate. Hence it is possible to further suppress the deterioration in display quality.

<5. Others>

In each of the above embodiments, it has been described that the transition period is made up of a plurality of sub-transition periods, but the present invention is not restricted to this. The transition period may include at least one sub-transition period. Further, the number of refresh frames and the number of non-refresh frames, the sequence of the polarity reversal and the like are not restricted to the examples shown in each of the above embodiments, and they can be variously changed. Further, each of the embodiments may be used as combined in accordance with the need for combination. For example, combining the above fourth embodiment and each of the embodiments allows more sufficient deterioration of the suppression of the display quality. In other manners, it is possible to carry out a variety of modifications on each of the above embodiments in a range not deviating from the gist of the present invention.

From the above, according to the present embodiment, it is possible to provide a display device capable of switching a refresh rate while suppressing deterioration in display quality and degradation in liquid crystal.

The present invention is applicable to a display device that performs a pause drive and a method for driving the same.

DESCRIPTION OF REFERENCE CHARACTERS

1: HOST
2: LIQUID CRYSTAL DISPLAY DEVICE
10: LIQUID CRYSTAL DISPLAY PANEL
20: FPC
30: BACKLIGHT UNIT
100: DISPLAY PORTION
110: PIXEL FORMATION PORTION
111: TFT (THIN-FILM TRANSISTOR)
200: DISPLAY CONTROL CIRCUIT
210: INTERFACE PORTION
211: DSI RECEIVER
220: COMMAND REGISTER
221: NVM (NON-VOLATILE MEMORY)
230: TIMING GENERATOR
231: OSC (OSCILLATOR)
240: LATCH CIRCUIT
250: INTERNAL POWER SUPPLY CIRCUIT
260: CONTROL SIGNAL OUTPUT PORTION FOR SIGNAL LINE
270: CONTROL SIGNAL OUTPUT PORTION FOR SCANNING LINE
280: FRAME MEMORY (RAM)
300: SIGNAL LINE DRIVE CIRCUIT
400: SCAN LINE DRIVE CIRCUIT
SL: SIGNAL LINE
GL: SCAN LINE
Vcom: COMMON POTENTIAL
Vlc: LIQUID CRYSTAL VOLTAGE
R: REFRESH
N: NON-REFRESH

The invention claimed is:

1. A display device, comprising:

a display portion which includes a plurality of pixel formation portions;

a drive portion which drives the display portion; and a display control portion which controls the drive portion based on data received from an external source, wherein the display control portion controls an alternating current drive;

a refresh rate of a screen of the display portion is determined according to a proportion of a refresh period, during which the screen is refreshed, and a non-refresh period, during which the screen is not refreshed;

when the display control portion determines that the refresh rate of the screen is to be switched from a first refresh rate to a second refresh rate, the display control portion sets a transition period that includes a positive polarity period and a negative polarity period;

before the transition period, the drive portion drives the display portion based on the first refresh rate in a first drive period;

after the transition period, the drive portion drives the display portion based on the second refresh rate in a second drive period;

during the transition period, the drive portion drives the display portion based on at least one refresh rate having a value that falls between the first refresh rate and the second refresh rate;

the positive polarity period includes a positive refresh frame, during which the screen is refreshed in a positive polarity, and one or more positive non-refresh frames immediately following the positive refresh frame, during which the screen of the display portion is not refreshed;

the negative polarity period includes a negative refresh frame, during which the screen is refreshed in a negative polarity, and one or more negative non-refresh frames immediately following the negative refresh frame, during which the screen of the display portion is not refreshed; and a total number of the one or more positive non-refresh frames is substantially the same as a total number of the one or more negative non-refresh frames, in a whole of the transition period.

2. The display device according to claim 1, wherein the display control portion provides the positive polarity period and the negative polarity period in substantially the same proportion as each other with respect to each of the at least one refresh rate during the transition period.

3. The display device according to claim 1, wherein the display control portion switches a potential supplied to the plurality of pixel formation portions according to the refresh rate of the screen.

4. The display device according to claim 1, wherein the display control portion:

switches from the second drive period to the first drive period when the display control portion receives, from the external source, image data corresponding to the screen of the display portion during a non-refresh period of the second drive period, and switches from the first drive period to the second drive period after the transition period.

5. The display device according to claim 1, wherein the pixel formation portion includes a thin-film transistor in which:

a control terminal is connected to a scan line in the display portion, a first conduction terminal is connected to a signal line in the display portion, a second conduction terminal is connected to a pixel electrode in the display portion, which is supplied with a potential in accordance with an image to be displayed, and a channel layer is formed of an oxide semiconductor.

6. A method for driving a display device having a display portion which includes a plurality of pixel formation portions, a drive portion which drives the display portion, and a display control portion which controls the drive portion based on data received from an external source, the method comprising:

a step of performing an alternating current drive; and a step of determining a refresh rate of a screen according to a proportion of a refresh period, during which the screen is refreshed, and a non-refresh period, during which the screen is not refreshed;

a transition step of setting a transition period that includes a positive polarity period and a negative polarity period; wherein the transition step is performed when the refresh rate of the screen is to be switched from a first refresh rate to a second refresh rate;

before the transition period, the method further comprises a step of driving the display portion based on the first refresh rate in a first drive period;

after the transition period, the method further comprises a step of driving the display portion based on the second refresh rate in a second drive period;

in the transition step, the display portion is driven based on at least one refresh rate having a value that falls between the first refresh rate and the second refresh rate;

in the transition step, the positive polarity period includes a positive refresh frame, during which the screen is refreshed in a positive polarity, and one or more positive non-refresh frames immediately following the positive refresh frame, during which the screen of the display portion is not refreshed;

in the transition step, the negative polarity period includes a negative refresh frame, during which the screen is refreshed in a negative polarity, and one or more negative non-refresh frames immediately following the negative refresh frame, during which the screen of the display portion is not refreshed; and in the transition step, a total number of the one or more positive non-refresh frames is substantially the same as a total number of the one or more negative non-refresh frames.

7. The drive method according to claim 6, wherein in the transition step, the positive polarity period and the negative polarity period are provided in substantially the same proportion as each other with respect to each of the at least one refresh rate during the transition period.

8. The display device according to claim 1, wherein a number of the one or more positive non-refresh frames included in the positive polarity period and a number of the one or more negative non-refresh frames included in the negative polarity period increase as the refresh rate of the screen decreases.

* * * * *